US007721715B2

(12) United States Patent
Sakagami et al.

(10) Patent No.: US 7,721,715 B2
(45) Date of Patent: May 25, 2010

(54) INJECTOR MOUNTING STRUCTURE

(75) Inventors: Nobuyuki Sakagami, Okazaki (JP); Koichi Takada, Aichi (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/261,927

(22) Filed: Oct. 30, 2008

(65) Prior Publication Data

US 2009/0159049 A1 Jun. 25, 2009

(30) Foreign Application Priority Data

Dec. 20, 2007 (JP) ..... 2007-329143

(51) Int. Cl.
*F02M 55/02* (2006.01)
*F02M 61/14* (2006.01)

(52) U.S. Cl. ..... 123/468; 123/447; 123/469; 123/456; 123/470

(58) Field of Classification Search ..... 123/456, 123/469, 470, 195 C, 447, 468
See application file for complete search history.

(56) References Cited

U.S. PATENT DOCUMENTS 2,966,146 A * 12/1960 Schweitzer et al. ..... 123/41.56
5,803,034 A * 9/1998 Gruber et al. ..... 123/90.38
6,237,571 B1 * 5/2001 Harrison ..... 123/469
6,298,814 B1 * 10/2001 Pearlman et al. ..... 123/90.38
2005/0061297 A1 * 3/2005 Oono ..... 123/458
2006/0185649 A1 * 8/2006 Muench et al. ..... 123/447

FOREIGN PATENT DOCUMENTS

| | | | |
|---|---|---|---|
| JP | 56-037417 | A | 4/1981 |
| JP | 61-549 | | 1/1986 |
| JP | 02-030963 | A | 2/1990 |
| JP | 3-122265 | A | 12/1991 |
| JP | 2504941 | A | 5/1996 |
| JP | 2000-073903 | A | 3/2000 |
| JP | 2001-263204 | A | 9/2001 |
| JP | 2001-295736 | A1 | 10/2001 |
| JP | 2002-310040 | A | 10/2002 |
| JP | 2005-036681 | B1 | 2/2005 |

* cited by examiner

*Primary Examiner*—Stephen K Cronin
*Assistant Examiner*—J. Page Hufty
(74) *Attorney, Agent, or Firm*—Birch, Stewart, Kolasch & Birch, LLP

(57) ABSTRACT

A common rail and injectors are connected by fuel pipes disposed outside a cylinder head cover. The common rail and the plurality of injectors integrated by the fuel pipes can be detached from a cylinder head, so that the plurality of injectors are detached from the cylinder head together with the common rail. In removing the cylinder head cover for inspection work, therefore, release of the connections of the fuel pipes to the injectors and to the common rail can be eliminated to minimize the release of the connection of piping.

5 Claims, 5 Drawing Sheets

INJECTOR MOUNTING STRUCTURE

The entire disclosure of Japanese Patent Application No. 2007-329143 filed Dec. 20, 2007 is expressly incorporated by reference herein.

BACKGROUND OF THE INVENTION

1. Field of the Invention

This invention relates to an injector mounting structure in an engine in which fuel injection is performed by injectors via a common rail (pressure accumulator).

2. Description of the Related Art

In a diesel engine, for example, fuel from a high pressure fuel pump is sent to a common rail (pressure accumulator), and fuel injection is performed by injectors via the common rail. With the diesel engine, therefore, the high pressure fuel pump and the common rail are connected by fuel supply pipes, and the common rail and a plurality of the injectors are connected by fuel pipes. Return pipes are provided between the common rail/the injectors and the high pressure fuel pump.

As a structure for mounting the injectors, a proposal has been made for a structure in which the injectors are mounted at predetermined positions of a cylinder head through a cylinder head cover, and fixed from outside the cylinder head cover via clamp members (see, for example, JP-A-2002-310040). A proposal has also been made for a structure in which fuel pipes for supplying fuel to the injectors are connected to the injectors outside the cylinder head cover (see, for example, JP-UM-B-61-549).

In the diesel engine, the cylinder head cover is detached, and valve clearance adjustment, etc. are carried out periodically for maintaining gas emission performance, noise suppression, and so on. For this purpose, the injector mounting structure disclosed in JP-A-2002-310040 has required that the clamps for the injectors fixed to the cylinder head cover be removed, the injectors detached, and the cylinder head cover detached. With the injector mounting structure disclosed in JP-UM-B-61-549, it has been necessary to remove the fuel pipes outside the cylinder head cover, disconnect the injectors and the common rail, then detach the injectors, and detach the cylinder head cover.

With the injector mounting structures proposed thus far, many man-hours and work hours have been necessary in detaching the cylinder head cover and making valve clearance adjustment, etc. periodically. Moreover, the high-pressure fuel pipe is usually connected by a flare nut (by a flare mechanism). Thus, the number of its attachments and detachments is limited, and the repetition of attachment and detachment of the fuel pipe lowers the reliability of the flare mechanism. Hence, it has been necessary to replace the fuel pipe each time a predetermined number of attachments and detachments have been carried out.

As described above, the conventional injector mounting structures have required many operating steps and working hours during periodical inspection work, and have entailed high maintenance costs. Also, the number of attachments and detachments of the fuel pipe is limited, and in order not to decrease the reliability of the connection of the fuel pipe, the fuel pipe needs to be replaced in good time. This has resulted in increased components costs.

Furthermore, the diesel engine for an automobile is a multi-cylinder engine such as a four- or six-cylinder engine. Thus, if a plurality of injectors in conformity with the number of the cylinders are detached, the relative positional relationship of the plurality of injectors with the cylinder head, and the relation between the common rail or the plurality of injectors and the fuel pipes may differ from those at the initial stage of assembly. Hence, much time and labor have been needed for readjustment at the time of reassembly.

SUMMARY OF THE INVENTION

The present invention has been accomplished in light of the above-described situations. It is an object of the invention to provide an injector mounting structure which enables a plurality of injectors to be detached from a cylinder head together with a common rail, while minimizing the release of connection to fuel piping and the common rail, during inspection work.

A first aspect of the present invention is an injector mounting structure in an engine in which fuel injection is performed by injectors via a common rail, comprising: a plurality of through-holes provided in a cylinder head cover, the injectors being inserted through the through-holes and fixed to a cylinder head; the common rail fixed to the cylinder head; and fuel pipes, disposed outside the cylinder head cover, for connecting the common rail to the injectors, wherein the common rail and the injectors integrated by the fuel pipes are detachable from the cylinder head.

According to the first aspect of the invention, the common rail and the plurality of injectors connected by the fuel pipes are detachable, in an integrated state, from the cylinder head. Thus, the plurality of injectors can be detached from the cylinder head together with the common rail. In removing the cylinder head cover for inspection work, the release of the connections of the fuel pipes to the injectors and to the common rail can be eliminated to minimize the release of the connection of piping.

Consequently, the connected state of the components at the initial stage of assembly can be maintained maximally, labor hours and work hours for inspection work can be markedly reduced without decreasing reliability, and work costs and component costs can be decreased.

In a second aspect of the present invention, the fuel pipes may each be in such a shape as to connect the common rail to each injector so that when a longitudinal direction of the common rail and a lower end of each injector are within an identical plane, each injector is located to approach the common rail upwardly.

According to the second aspect of the invention, the common rail and each injector are connected by the fuel pipe in such a manner that the lower parts of the plurality of injectors are located away from the common rail. Thus, the common rail and the injectors can be stably placed, as an integrated assembly component having a lower portion fanning out, in a predetermined place such as a workbench.

When such an assembly component is placed on the workbench, it is desirable to lay a cushioning material (e.g., sponge) for protecting leading end portions of the injectors, and place the injectors thereon.

In a third aspect of the present invention, amounting surface of the cylinder head, where the common rail is fixed, may incline upwardly toward each injector with respect to a longitudinal direction of each injector.

According to the third aspect of the invention, the common rail can be dismounted from the mounting surface, without excess resistance caused, when the injectors are pulled out upward in the longitudinal direction. Furthermore, the mounting surface can be structured such that influence on the size of the cylinder head, in a direction orthogonal to the longitudinal direction of the injector, can be minimized, and excess resistance can be suppressed during detachment of the common rail.

In a fourth aspect of the present invention, a return pipe to a fuel pump may be connected to the injectors and the common rail connected by the fuel pipes.

According to the fourth aspect of the invention, the plurality of injectors and the common rail can be detached from the cylinder head together with the return pipe to the fuel tank.

The injector mounting structure according to the present invention can eliminate the disconnection of the fuel pipe from the injector and common rail during inspection work to minimize the disconnection of piping and remove the plurality of injectors from the cylinder head together with the common rail.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
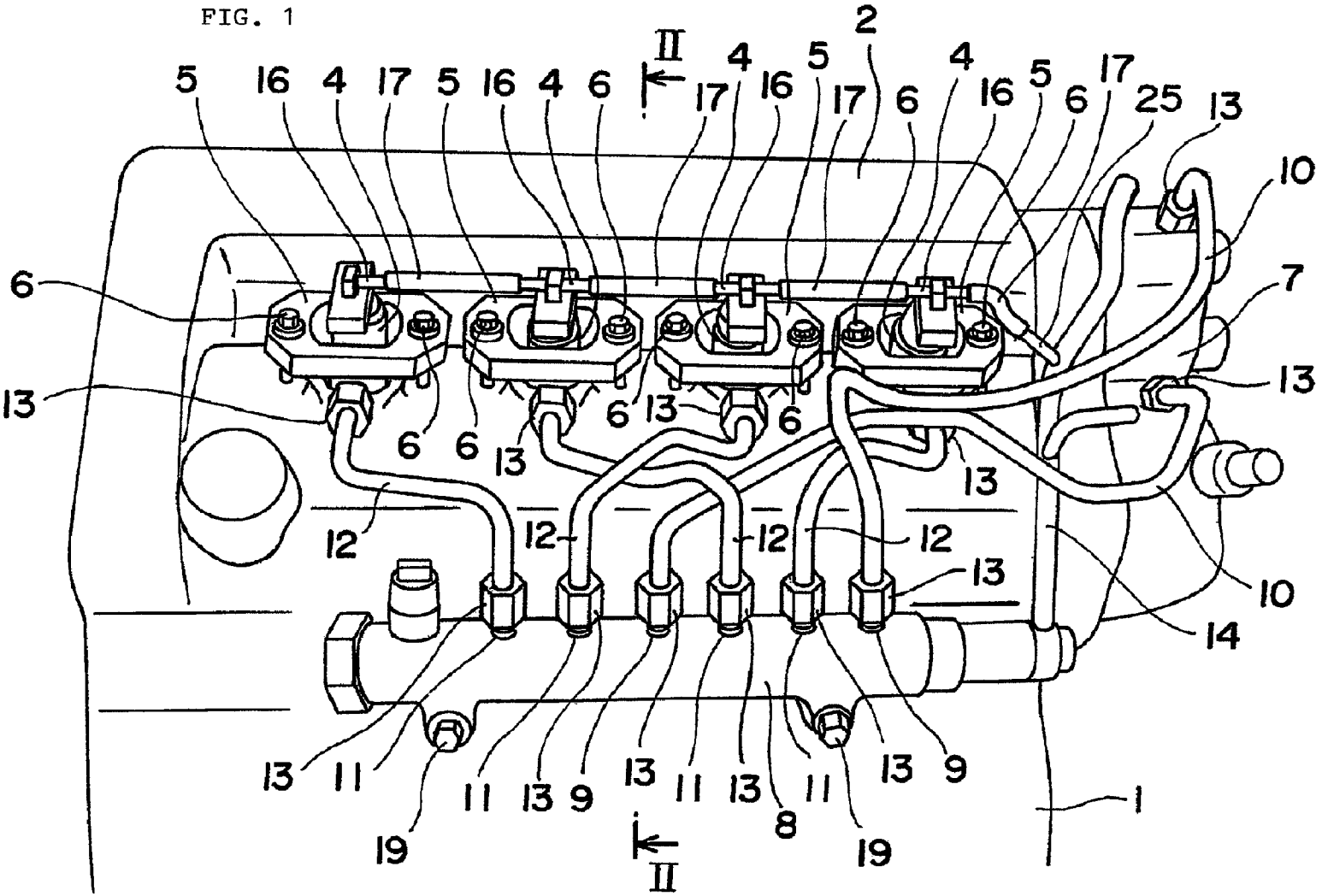
FIG. 1 is an upper external view of an engine (diesel engine) to which an injector mounting structure according to an embodiment of the present invention has been applied.

An embodiment of the present invention will be described in detail with reference to the accompanying drawings. An injector mounting structure according to the present invention is not limited to one applied to a diesel engine, if it is used in an engine having a common rail.

A diesel engine to which the injector mounting structure according to the embodiment of the present invention has been applied will be described based on FIGS. 1 and 2.

A cylinder head cover 2 is fixed to a cylinder head 1, and through-holes 3 (see FIG. 2) are provided (four through-holes in an example shown in FIG. 1) in an upper surface of the cylinder head cover 2 in conformity with the number of cylinders. An injector 4 is inserted through each through-hole 3 (see FIG. 2), and the injectors 4 are held by the cylinder head 1 in such a state that the leading end of each injector 4 (i.e., a valve portion thereof) faces a combustion chamber (not shown).

An upper part of each injector 4 is held by a support fitting 5, and the support fitting 5 is mounted on the cylinder head cover 2 from outside (from an upper side) via two bolts 6. The two bolts 6 are screwed to the cylinder head 1 through the cylinder head cover 2, whereby each injector 4 is fixed to the cylinder head 1 in a vertically extending state.

A high pressure injection pump 7 is mounted on one end side (right-hand side in FIG. 1) in the axial direction (right-and-left direction in FIG. 1) of the cylinder head 1. A common rail 8 extending in the axial direction (right-and-left direction in FIG. 1) of the cylinder head 1 is mounted on a side surface of the cylinder head 1 via bolts 19. The common rail 8 is provided with fuel ports 9 at two locations, and fuel supply pipes 10 from the high pressure injection pump 7 are connected to the fuel ports 9.

The common rail 8 is provided with fuel supply ports 11 in correspondence with the number (four) of the injectors 4, and the fuel supply ports 11 are connected to the injectors 4 by fuel pipes 12. Four of the fuel pipes 12 are laid such that each of their lengths ranging from the fuel supply port 11 to the injector 4 is the same.

The fuel supply pipe 10 connecting the high pressure injection pump 7 to the common rail 8, and the fuel pipe 12 connecting the common rail 8 to the injector 4 are connected, respectively, such that their respective ends are pressed against connection ports, and sealed, by flare mechanisms.

That is, the connection between the high pressure injection pump 7 and the fuel supply pipe 10, the connection between the fuel port 9 of the common rail 8 and the fuel supply pipe 10, the connection between the fuel supply port 11 of the common rail 8 and the fuel pipe 12, and the connection between the injector 4 and the fuel pipe 12 are performed by tightening flare nuts 13. By tightening the flare nut 13, the end of the piping is pressed against the connection port, and the pipe is fixed, with its end sealed, to the connection port.

Namely, the common rail 8 and the four injectors 4 connected by the fuel pipes 12 constitute an assembly component 31, and the assembly component 31 in an integrated state is detached from the cylinder head 1, as will be described later.

A return pipe 14 is connected for returning fuel from the common rail 8 and the injector 4 to the high pressure injection pump 7 (fuel tank). Return ports 16 and 25 are provided in an upper part of each injector 4 and a halfway part of the return pipe 14, respectively. The return port 16 of each injector 4 and the return port 25 of the return pipe 14 are connected in series by communication pipes 17 serving as return pipes.

Thus, drain fuel from the common rail 8 and drain fuel from the injectors 4 are returned to the fuel tank through the return ports 16, communication pipes 17, and return pipe 14.

Figure 2:
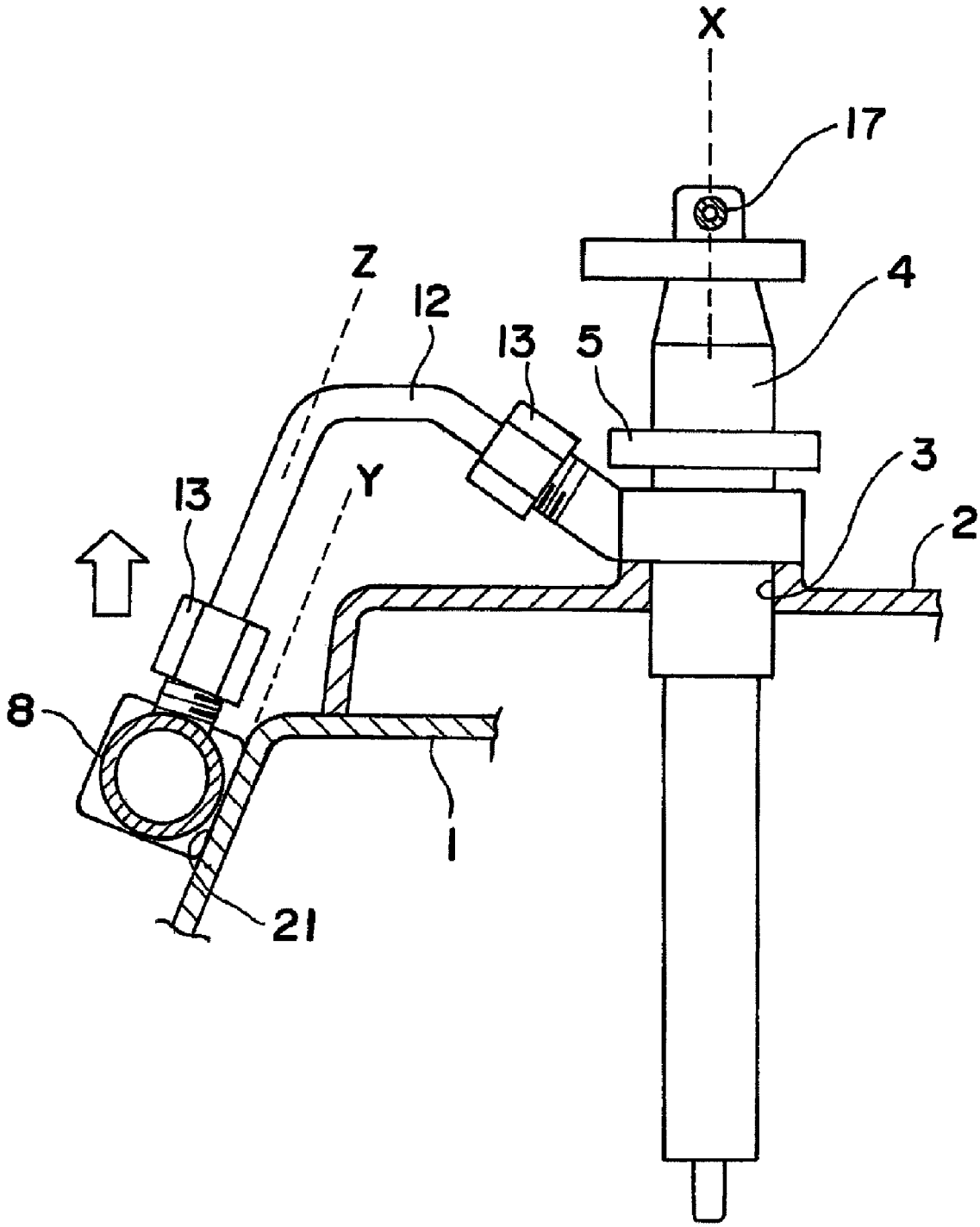
FIG. 2 is a view taken on line II-II in FIG. 1.

On the other hand, a mounting surface 21 of the cylinder head 1, where the common rail 8 is fixed, defines a surface having an upper part inclined toward the injector 4 (in a Y-axis direction in FIG. 2) with respect to the longitudinal direction of the injector 4 (X-axis direction in FIG. 2), as shown in FIG. 2.

That is, the mounting surface 21 is formed to be inclined upwardly toward the injector 4 with respect to the longitudinal direction of the injector 4.

Because of this configuration, when the injector 4 is to be removed upward in the longitudinal direction, the common rail 8 is moved in a direction where it departs from the mounting surface 21 (in a direction indicated by an arrow in FIG. 2). Thus, the common rail 8 can be removed, without excess resistance caused between the common rail 8 and the cylinder head 1.

Furthermore, the mounting surface 21 can be structured such that influence on the size of the cylinder head 1, in a direction orthogonal to the longitudinal direction (in a horizontal direction) of the injector 4, can be minimized, and excess resistance can be suppressed during detachment of the common rail 8.

As shown in FIG. 2, moreover, the fuel pipe 12 connects the common rail 8 to each injector 4 such that a lower part of the injector 4 is located to separate from the common rail 8 with respect to the direction of the fuel pipe 12 at the site of its connection to the common rail 8 (i.e., a Z-axis direction in FIG. 2). That is, the Z-axis following the direction of the fuel pipe 12 at the site of its connection to the common rail 8, and the X-axis following the longitudinal direction of the injector 4 are set to form an angle at which they cross each other above.

That is, the fuel pipe 12 is in such a shape as to connect the common rail 8 to each injector 4 so that when the longitudinal direction of the common rail 8 and the lower end of each injector 4 are within the same plane, each injector 4 is located to separate downwardly from the common rail 8.

Figure 4:
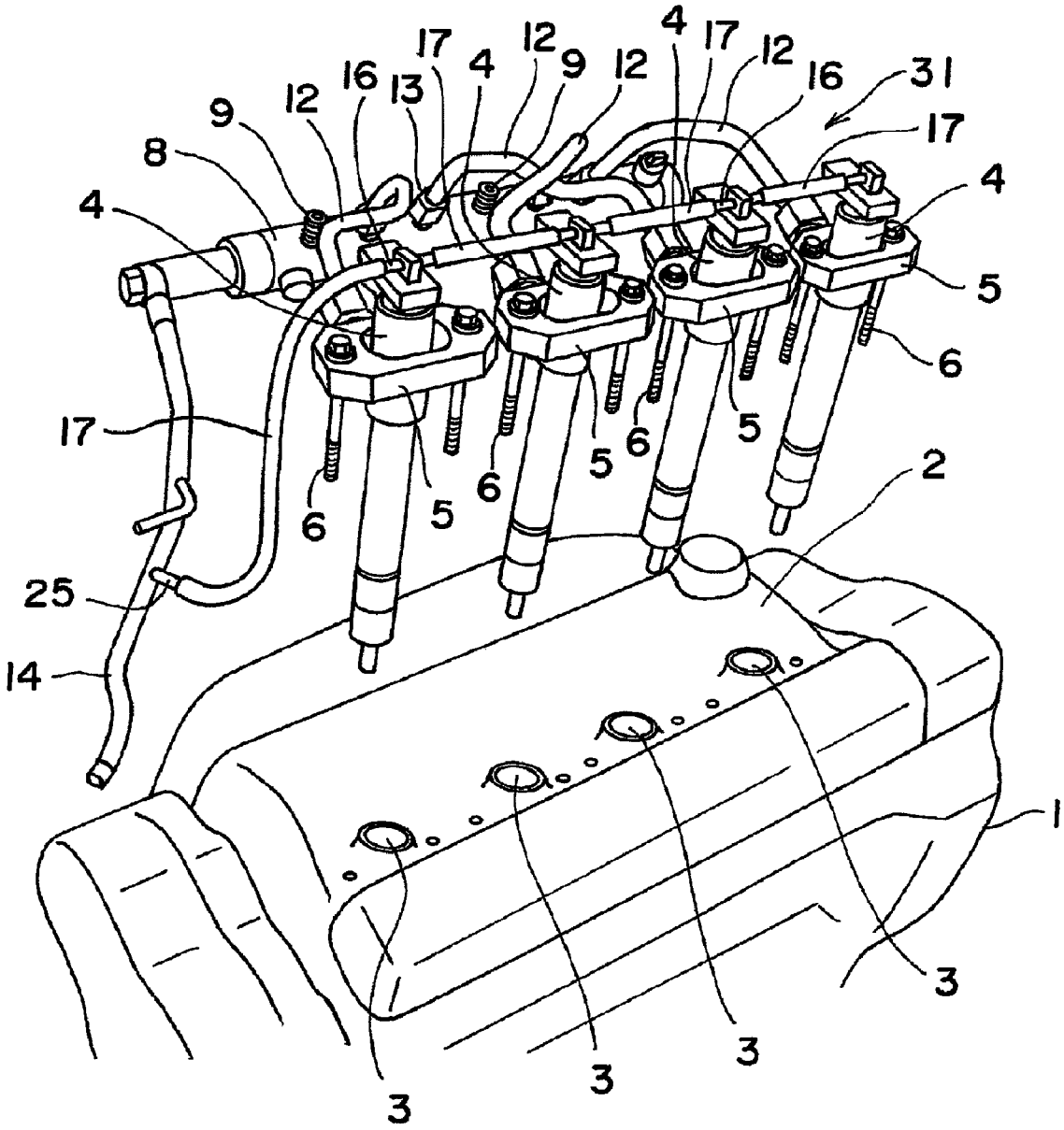
FIG. 4 is an external view showing a state in which injectors have been removed.
Figure 5:
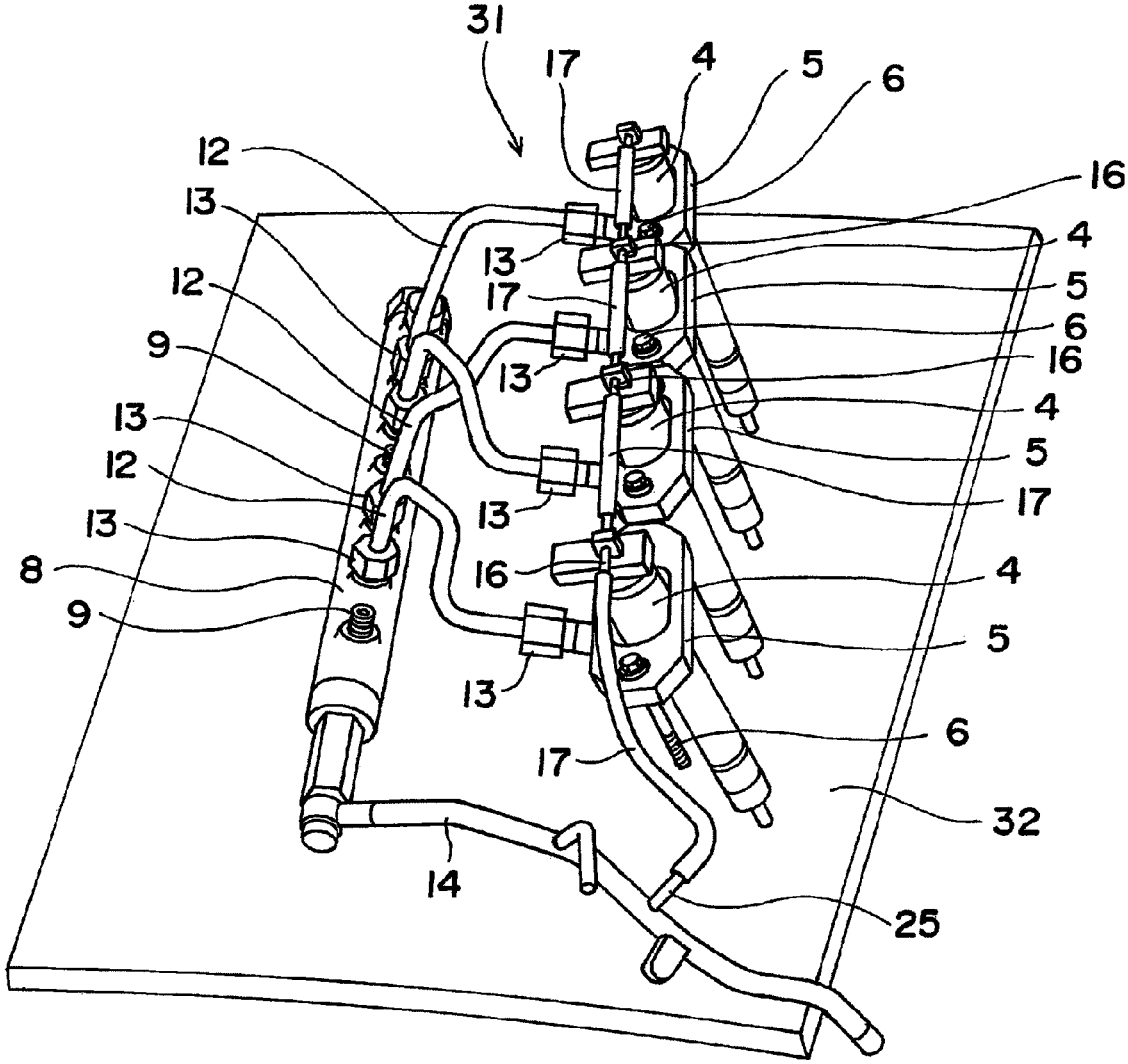
FIG. 5 is an external view showing a state in which an assembly component is placed on a workbench.

Thus, when the injectors 4 are removed, the common rail 8 and each injector 4 are connected together, with the lower parts of the four injectors 4 inclining outward, and they can be placed stably as the integrated assembly component 31 having a lower portion fanning out (see FIG. 4).

Figure 3:
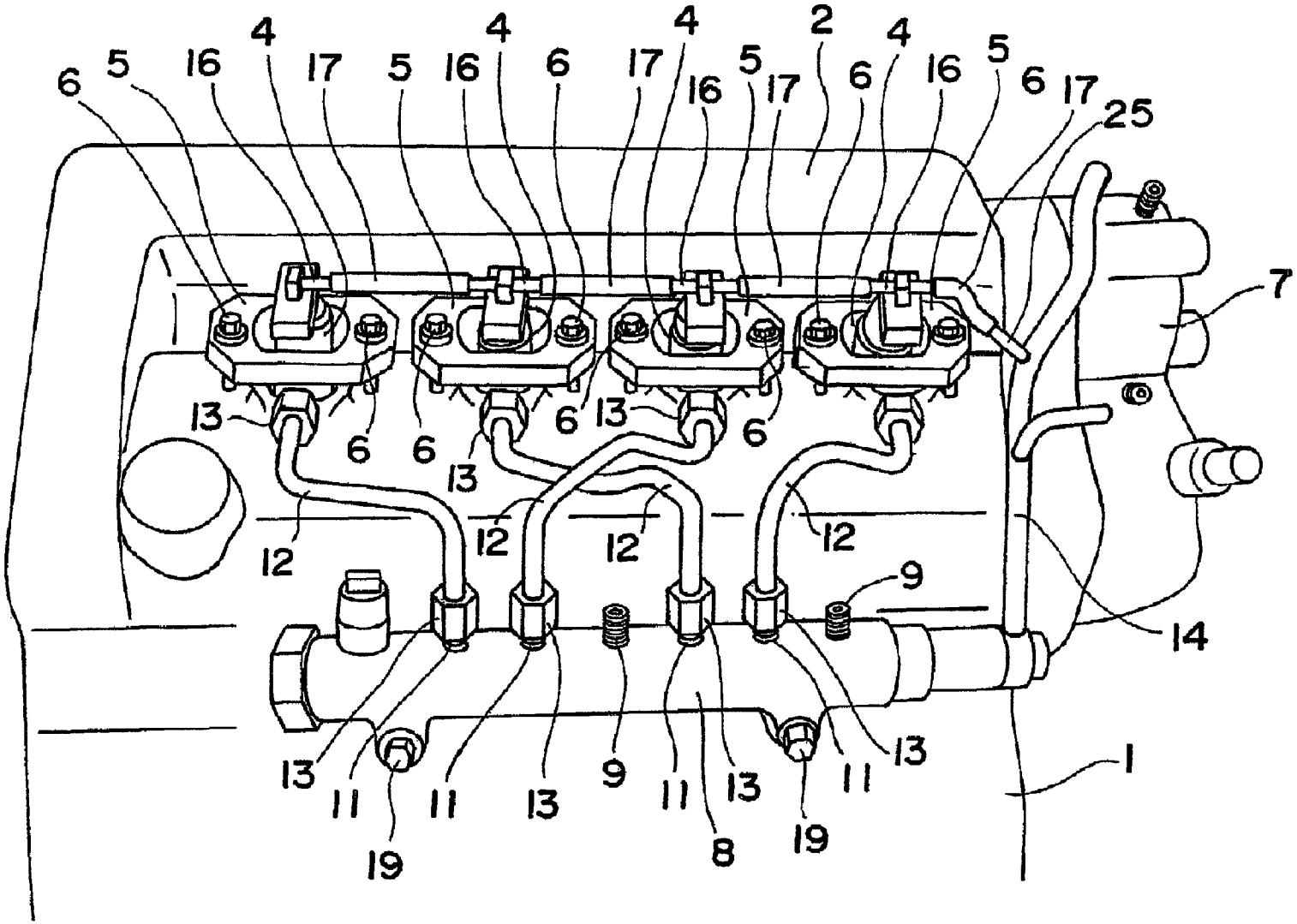
FIG. 3 is an external view showing a state in which fuel supply pipes in FIG. 1 have been detached.

When the cylinder head cover 2 is to be detached, for example, for the adjustment of valve clearance in the engine to which the above-described injector mounting structure has been applied, a relevant operation is performed by the following procedure:

The fuel supply pipes 10 are detached from the engine in the state shown in FIGS. 1 and 2. The flare nuts 13 are loosened from the fuel ports 9 at the two locations, and the flare nuts 13 on the high pressure injection pump 7 are also loosened to remove the fuel supply pipes 10 (the state of FIG. 3). Then, the bolts 6 at the four support fittings 5 are loosened to release the fixing of the injectors 4 to the cylinder head cover 2, and the bolts 19 are undone to release the fixing of the common rail 8 to the cylinder head 1.

In this state, the plurality of injectors 4 are pulled out upward (upward on the X-axis in FIG. 2), whereby the plurality of injectors 4 are detached from the cylinder head 1 together with the common rail 8 connected to them by the fuel pipes 12 (the state of FIG. 4).

Since the common rail 8 moves away from the mounting surface 21 of the cylinder head 1, the common rail 8 can be dismounted from the mounting surface 21, without excess resistance occurring between the common rail 8 and the cylinder head 1. At this time, the return pipe 14 for drain fuel and the communication pipes 17 remain mounted.

The common rail 8 and the plurality of injectors 4 connected by the fuel pipes 12 are placed on a workbench 32 as the assembly component 31 having its lower portion fanning out, with the lower parts of the injectors 4 inclining outward and the common rail 8 directed downward. Since the injectors 4 and the common rail 8 have been detached in this manner, the cylinder head cover 2 is removed, and then the necessary operation is performed.

With the engine having the above-described injector mounting structure applied thereto, the plurality of injectors 4 can be detached from the cylinder head 1, with their connection to the common rail 8 being maintained (in the integrated state), when the cylinder head cover 2 is to be removed. By so doing, in removing the cylinder head cover 2 for inspection work, the release of the connections of the fuel pipe 12 to each injector 4 and the common rail 8 can be eliminated to minimize the release of the connection of the piping.

Thus, the connected state of the components at the initial stage of assembly can be maintained maximally, and the detachment and attachment of the fuel pipes 12 by the flare nuts 13 can be eliminated. As a result, the work hours can be decreased, the reliability of the assembly component 31 is no more lowered, and the number of the attachments and detachments of the fuel pipe 12 connected by the flare mechanism is not so affected as to be limited. That is, even if inspection work is repeated, the replacement of the fuel pipe 12 and the flare nut 13 is unnecessary.

Hence, there can be achieved an injector mounting structure which can eliminate the disconnections of the fuel pipe 12 from each injector 4 and the common rail 8 during inspection work to minimize the disconnection of the piping, and remove the plurality of injectors 4 from the cylinder head 1 together with the common rail 8.

Besides, the common rail 8 and the plurality of injectors 4 are connected by the fuel pipes 12, and can be placed on the workbench 32 as the assembly component 31, with the lower parts of the injectors 4 and the common rail 8 being pointed downward to make a lower portion of the assembly component 31 fan out. Thus, the assembly component 31 can be placed on the workbench 32 in a stable state, and it is not that the safety of the assembly component 31 is impaired, for example, as a result of toppling over.

According to the engine to which the above-described injector mounting structure has been applied, labor hours and work hours for inspection work due to the adjustment of valve clearance or the like can be markedly reduced, and work costs and component costs in inspection work can be decreased.

The present invention can be utilized in the industrial field of an injection mounting structure in an engine in which fuel injection takes place by injectors via a common rail (pressure accumulator).

While the present invention has been described in the foregoing fashion, it is to be understood that the invention is not limited thereby, but may be varied in many other ways. Such variations are not to be regarded as a departure from the spirit and scope of the invention, and all such modifications as would be obvious to one skilled in the art are intended to be included within the scope of the appended claims.

What is claimed is:

1. An injector mounting structure in an engine in which fuel injection is performed by injectors via a common rail, comprising:

a plurality of through-holes provided in a cylinder head cover, the injectors being inserted through the through-holes and fixed to a cylinder head;

the common rail fixed to the cylinder head; and fuel pipes, disposed outside the cylinder head cover, for connecting the common rail to the injectors, wherein the fuel pipes are each in such a shape as to connect the common rail to each injector so that when a longitudinal direction of the common rail and a lower end of each injector are within an identical plane, each injector is located to approach the common rail upwardly, a direction in which the fuel pipe extends from a site of connection thereof to the common rail and a longitudinal direction of the injector are set to form an angle at which the fuel pipe and the injector cross each other above the injector, and the common rail and the injectors integrated by the fuel pipes are detachable from the cylinder head and the cylinder head cover.

2. The injector mounting structure according to claim 1, wherein a mounting surface of the cylinder head, where the common rail is fixed, inclines upwardly toward each injector with respect to a longitudinal direction of each injector.

3. The injector mounting structure according to claim 1, wherein a return pipe to a fuel pump is connected to the injectors and the common rail connected by the fuel pipes.

4. The injector mounting structure according to claim 1, wherein each injector is mounted on the cylinder head cover from outside the cylinder head cover via a support fitting.

5. The injector mounting structure according to claim 4, wherein the support fitting is annular, and an upper part of each injector is inserted through an internal space of the support fitting, such that the support fitting is held integrally by each injector.

* * * * *